United States Patent [19]

Off et al.

[11] 4,307,675

[45] Dec. 29, 1981

[54] SEMI-AUTOMATIC PANEL SERGER

[75] Inventors: Joseph W. A. Off, Irving; Judson H. Early; William C. Huguley, both of Dallas, all of Tex.

[73] Assignee: Haggar Company, Dallas, Tex.

[21] Appl. No.: 13,556

[22] Filed: Feb. 13, 1979

[51] Int. Cl.[3] ..... D05B 33/02; D05B 35/10

[52] U.S. Cl. ..... 112/121.29; 112/153; 112/308; 112/312; 112/324

[58] Field of Search ..... 112/153, 152, 121.11, 112/121.12, 121.15, 121.29, 312, 324, 308, 51, 136; 26/51.5

[56] References Cited

U.S. PATENT DOCUMENTS

| | | | |
|---|---|---|---|
| 3,631,826 | 1/1972 | Morgan | 112/153 X |
| 3,670,674 | 6/1972 | Conner | 112/121.29 |
| 3,903,820 | 9/1975 | Kleinschmidt et al. | 112/153 |
| 4,067,271 | 1/1978 | Angele et al. | 112/153 |
| 4,067,272 | 1/1978 | Marjorio | 112/121.29 |
| 4,074,640 | 2/1978 | Chano et al. | 112/153 |
| 4,133,279 | 1/1979 | Wajcmann | 112/153 |

FOREIGN PATENT DOCUMENTS

| | | | |
|---|---|---|---|
| 1455255 | 11/1976 | United Kingdom | 112/153 |

*Primary Examiner*—H. Hampton Hunter

*Attorney, Agent, or Firm*—Richards, Harris & Medlock

[57] ABSTRACT

An apparatus (10) for providing stitching along the edges of material panels on a semi-automatic basis includes a sewing machine (28) and a material locator assembly (30). The locator assembly (30) incorporates a guide member (62) with a predetermined guide edge for engaging the edges of the material panels prior to sewing. Sensor (46) senses the presence of a material panel in proximity with the sewing machine (28). Sensor (70) senses engagement with guide member (62) by a material panel. A clamp assembly (122) selectively immobilizes each material panel after sewing and before collection by stacker assembly (34). Preferably, air flow is directed through ports (50) formed in a portion of the working surface adjacent to the sewing machine (28) to facilitate advancement of each material panel.

17 Claims, 18 Drawing Figures

FIG. 10
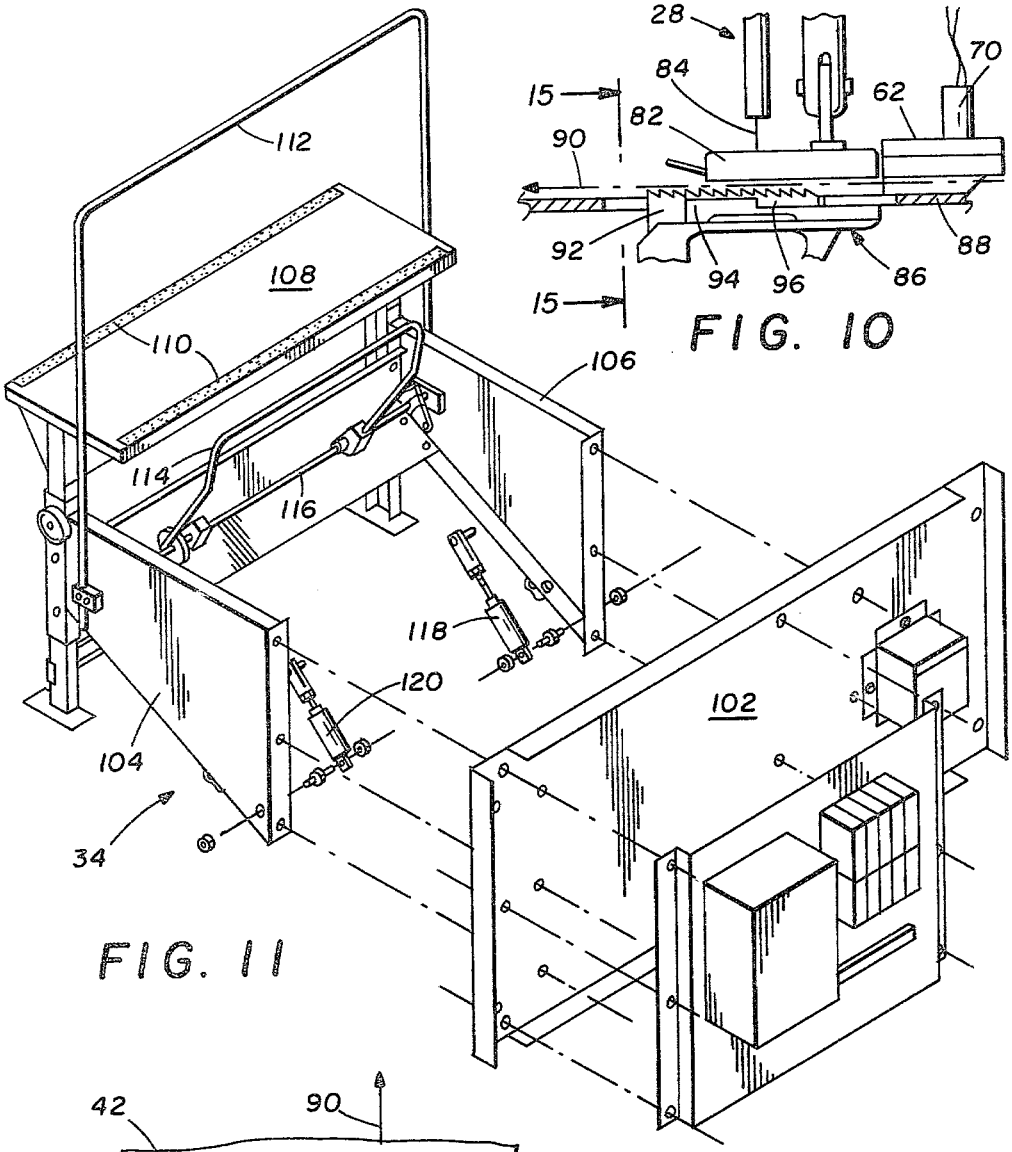
FIG. 11
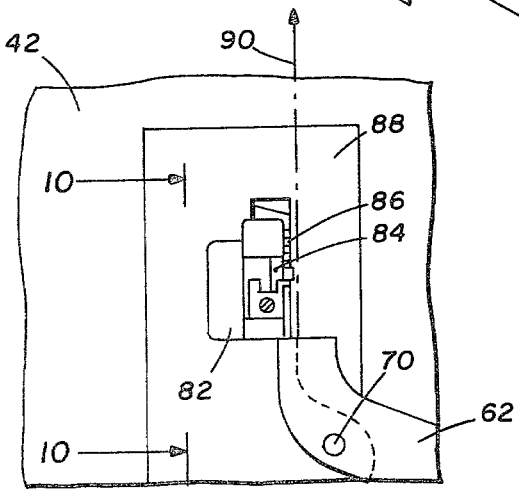
FIG. 9

SEMI-AUTOMATIC PANEL SERGER

TECHNICAL FIELD

The present invention relates generally to sewing machines. More particularly, this invention concerns a semi-automatic device for providing a serge stitch about the periphery of a piece of fabric.

BACKGROUND ART

Garments are constructed by interconnecting panels of fabric material. The fabric material is typically woven from natural or synthetic textile fibers. Because woven materials have a tendency to become frayed at the edges, a serge or wraparound stitch is usually provided about the periphery of each fabric panel before assembly into the garment to prevent fraying. Either single thread or multiple thread serge stitches can be utilized. The provision of serge stitching comprises an important step in the production of high quality garments.

Traditionally, panels of fabric have been provided with serge stitching by individuals operating sewing machines. Since the various sections comprising a particular garment are of irregular configurations, much dexterity and experience are required of an operator to develop proficiency at serge stitching. Rapid coordination of the operator's eyes, hands and feet is necessary. Considerable skill is thus involved at high rates of production. There have been some attempts in the past to automate this stage of garment production. One approach has been the use of complex mechanical guiding devices. However, such devices are expensive and suffer from the further disadvantages of low reliability and high maintenance. There is thus a need for a less costly serge device requiring a minimum of manual intervention.

DISCLOSURE OF INVENTION

The present invention comprises a semi-automatic panel serger which overcomes the foregoing and other problems associated with the prior art. In accordance with the broader aspects of the invention, a novel guide member is utilized to properly feed the edge of panels of fabric into a sewing station. No active mechanical devices are required to achieve accurate feeding of the panels. The guide member aligns and positions the edge of the panel as it is drawn about its periphery through the sewing station. Aside from initiating the serging operation for each panel, manual intervention by the operator is required only at the sharp angles in the periphery of each panel. Use of the invention significantly reduces the skill and training necessary for an operator to reach proficiency. Simplicity, reliability and low maintenance are some of the advantages of the present invention.

More specifically, the present invention comprises a semi-automatic panel serger including a sewing machine mounted in a working surface. An arcuate guide member having predetermined surfaces in the lower side thereof is secured to the working surface in front of the sewing machine. Scanners or photosensors are provided in the working surface and the guide member to sense the presence of a fabric panel. After one edge of a panel is positioned under the sewing machine and against the guide member, the sewing machine is actuated by the operator to initiate the serging operation. Airflow through ports provided in the working surface urges the panel forward as it is drawn by the sewing machine along its periphery. A stitch is accurately provided along straight and arcuate peripheral portions of a panel without any manipulation from the operator. Manual guiding by the operator is only required at corners or sharp junctures in the periphery of the panel. If desired, a stacker assembly can be utilized to automatically arrange the panels for collection subsequent to the serging operation.

BRIEF DESCRIPTION OF DRAWINGS

A more complete understanding of the invention can be had by reference to the following Detailed Description in conjunction with the accompanying Drawings, wherein:

FIG. 9 is a plan illustration showing the relation between the guide member and the sewing station;

FIG. 10 is a sectional view taken along lines 10—10 of FIG. 9 in the direction of the arrows;

FIG. 11 is a perspective view, partly exploded, of a stacker assembly which can be used with the invention;

DETAILED DESCRIPTION

Figure 1:
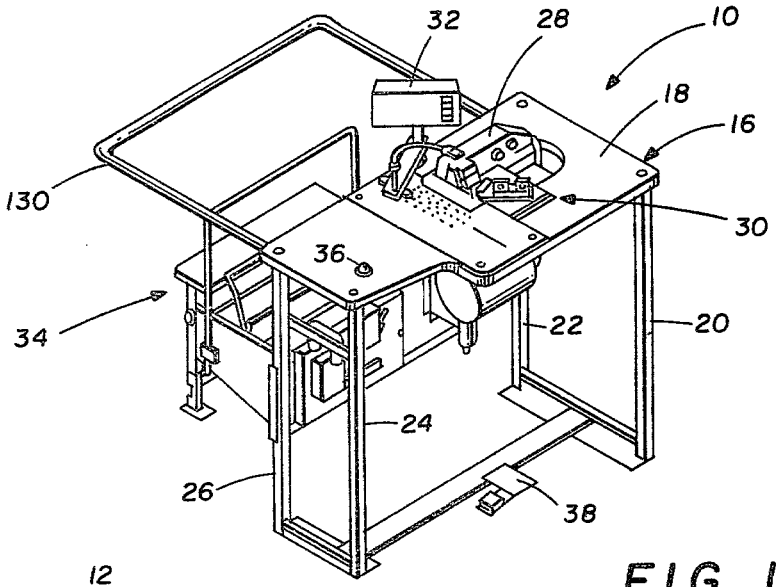
FIG. 1 is a perspective illustration of a semi automatic panel serger incorporating the invention.
Figure 2:
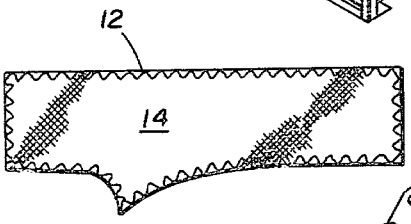
FIG. 2 is a plan view of a panel or section of material which can be used with the invention.

Referring now to the Drawings, wherein like reference numerals designate like or corresponding parts throughout the several views, and particularly referring to FIGS. 1 and 2 there is shown a semi-automatic panel serger apparatus 10 incorporating the invention. The apparatus 10 is useful in providing a peripheral edge stitch to precut sections of woven material prior to assembly of the sections into a garment. For example, apparatus 10 can be employed to provide a serge stitch 12 about the periphery of a trouser panel 14 such as that shown in FIG. 2. Apparatus 10 operates on a semi-automatic basis, requiring minimum intervention by a human operator. The apparatus 10 achieves high production rates without the operator skill and coordination heretofore required, thereby enabling an operator to become proficient in a shorter time.

The apparatus 10 is mounted on a table 16, which comprises a top 18 supported by legs 20, 22, 24 and 26. A suitable sewing machine 28 is mounted in table top 18, and a material locator assembly 30 is positioned adjacent to the sewing machine. A housing 32 containing a suitable microprocessor controller for apparatus 10 is also mounted on table top 18. The panel of housing 32 includes appropriate controls and switches for apparatus 10. As will be explained in further detail, apparatus 10 can be operated in any of several modes. When used with trouser panels, apparatus 10 can have four modes: front or back trouser panel, and training or semi-automatic operation.

In the preferred embodiment, apparatus 10 further includes a stacker assembly 34 located in the back of table 16. Hand switch 36 and foot switch 38 are provided for manipulation by an operator (not shown) standing or sitting in front of table 16.

Figure 3:
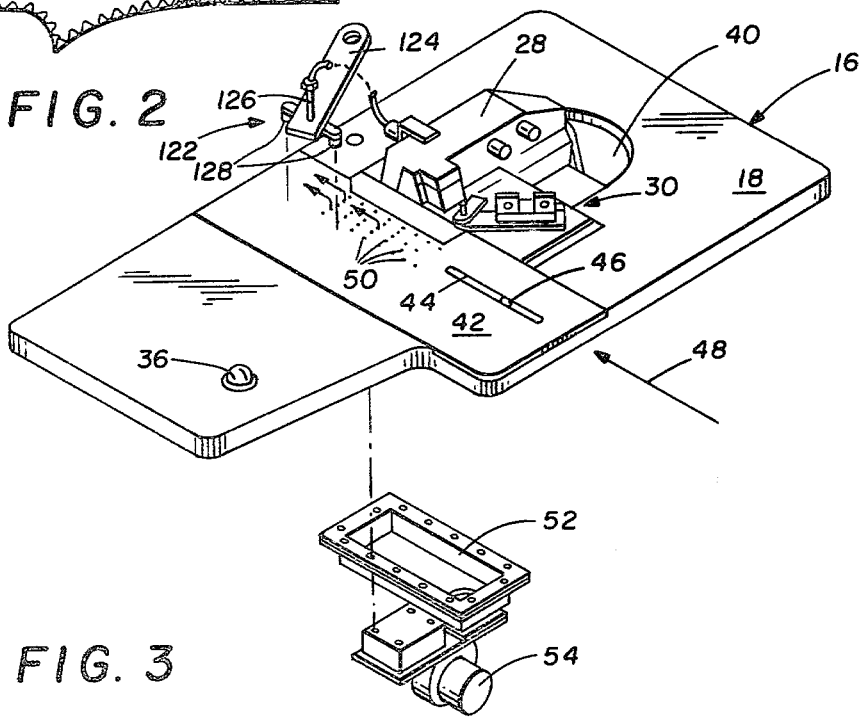
FIG. 3 is an enlarged perspective illustration, partly exploded, of a portion of the invention.

Further details of table top 18 are shown in FIG. 3. Housing 32 containing the microprocessor controller for apparatus 10 has been omitted from FIG. 3 for clarity. The sewing machine 28 is recessed in an opening 40 in table top 18. Any one of several commercially available machines having a presser foot, needle and feed dogs can be utilized for machine 28. For example, the Rimoldi Model 228 machine has been found satisfactory. Plate 42 extends adjacent to sewing machine 28 and forms a part of table top 18. Plate 42 is preferably slightly recessed into table top 18. The plate 42 includes a slot 44, beneath which a conventional scanner or photosensor 46 is mounted. The photosensor 46 is slidably mounted beneath table top 18 for adjustable positioning along slot 44.

Figure 14:
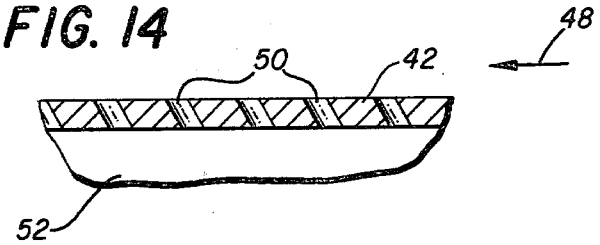
FIG. 14 is a sectional illustration of a portion of the ported table surface.

It will thus be appreciated that plate 42 comprises a working surface onto which a panel or section of fabric is received in the direction indicated by arrow 48 for sewing by machine 28. The upper surface of plate 42 is preferably smooth and highly polished. In accordance with the preferred construction, plate 42 includes a plurality of ports 50 angled in the direction of material feed, as is more clearly shown in FIG. 14. A plenum chamber 52 is connected to the bottom of plate 42 underneath ports 50. A blower 54 supplies air to the plenum chamber 52 to cause positive air flow from ports 50 and thus provide a low friction air cushion facilitating feed of garment panels into sewing machine 28. As will be explained more fully hereinafter, the purpose of photosensor 46 is to sense the end or completion of a garment panel being sewn, and to generate an appropriate control signal.

Figure 4:
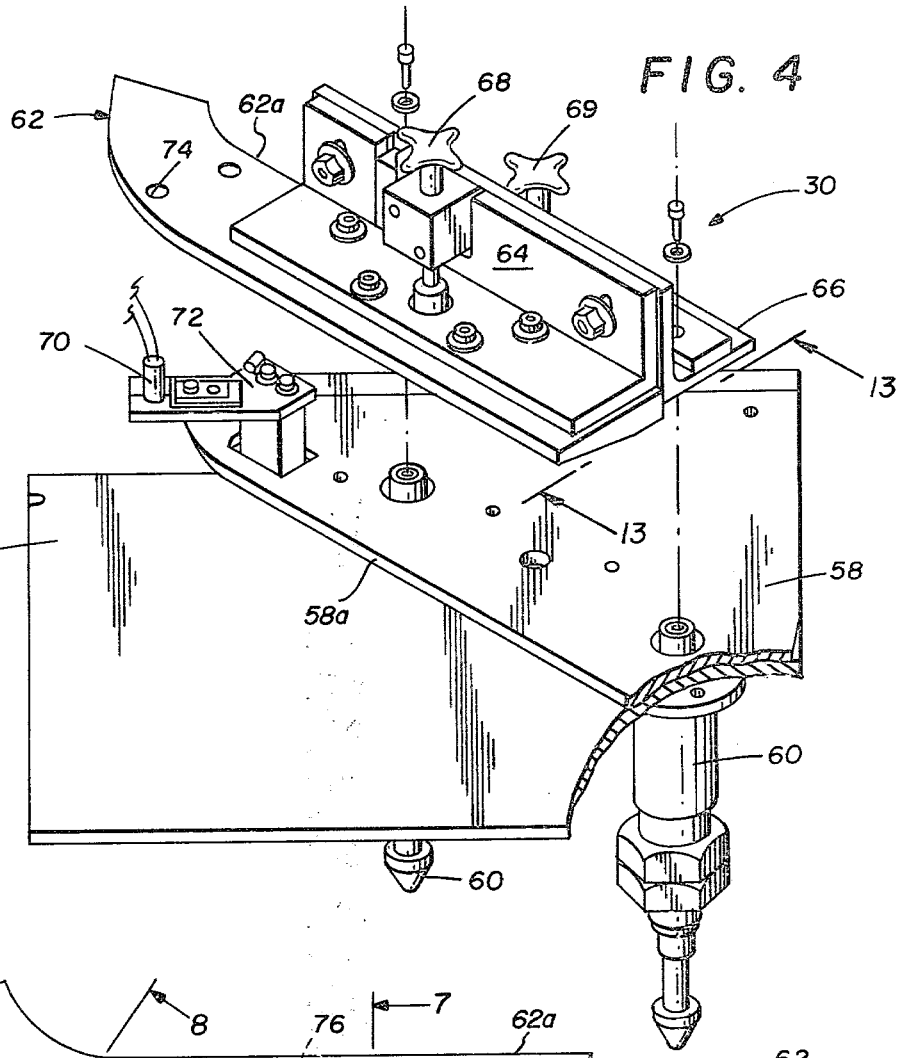
FIG. 4 is an enlarged perspective illustration, partly exploded, of the material locater assembly utilized in the invention.
Figure 5:
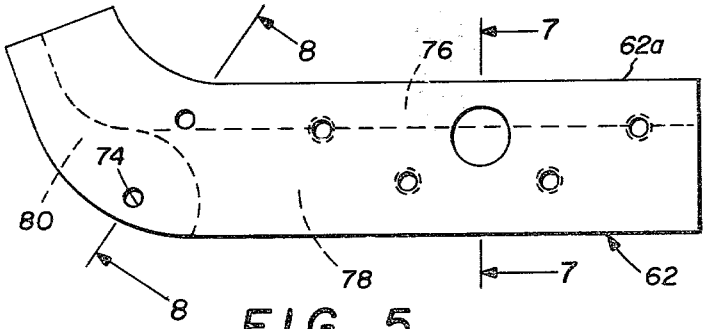
FIG. 5 is a plan view of the guide member utilized in the assembly of FIG. 4.
Figure 7:
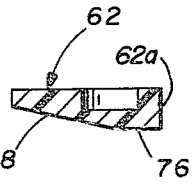
FIGS. 7 and 8 are cross sectional views taken along lines 7—7 and 8—8, respectively, of FIG. 5 in the directions of the arrows.
Figure 6:
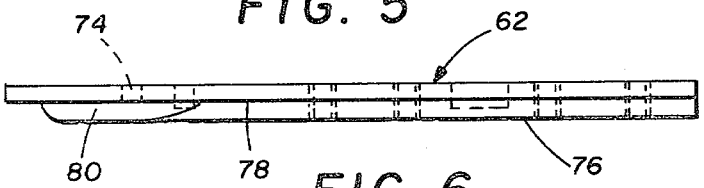
FIG. 6 is an edge view of the guide member shown in FIG. 5.

Referring to FIG. 4, there are shown the constructional details of panel locator assembly 30. The locator assembly 30 is removably positioned in table top 18 in front of sewing machine 28. Assembly 30 includes a first plate 56, which is substantially flush with table top 18 and plate 42, and a second plate 58. Plates 56 and 58 are secured together. It will be understood that plate 56 also comprises a portion of the working surface for receiving panels of fabric drawn through sewing machine 28. A pair of locking pins 60 extend downwardly from plates 56 and 58 for engagement with cooperating fittings within the table 16. In this manner, panel locator assembly 30 can be lifted out of table 16 to faciliate maintenance of sewing machine 28.

Referring to FIGS. 5–8 and 13 in conjunction with FIG. 4, the locator assembly 30 includes guide member 62. The guide member 62 is supported by a bracket 64. Guide member 62 is supported with the inside edge 62*a* closely engaging the corresponding outside edge 58*a* of plate 58. The bracket 64 in turn is slidably secured to a bracket 66 affixed to plate 58. A knob 68 is provided for adjustment of guide member 62 and bracket 64 relative to fixed bracket 66. A knob 69 is provided for releasing bracket 66 from plate 58. It will thus be appreciated that the vertical spacing between guide member 62 and plate 56 can be easily adjusted by rotation of knob 68 to compensate for the weight or thickness of the material panels being sewn by apparatus 10.

A scanner or photosensor 70 carried on an arm 72 is positioned over the back end of guide member 62. Through an opening 74 in guide member 62, photosensor 70 senses the presence of material under the guide member to generate a predetermined control signal, as will be more fully explained hereinafter.

Figure 8:
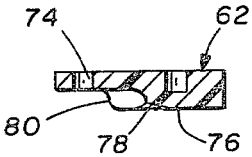
Figure 12A:
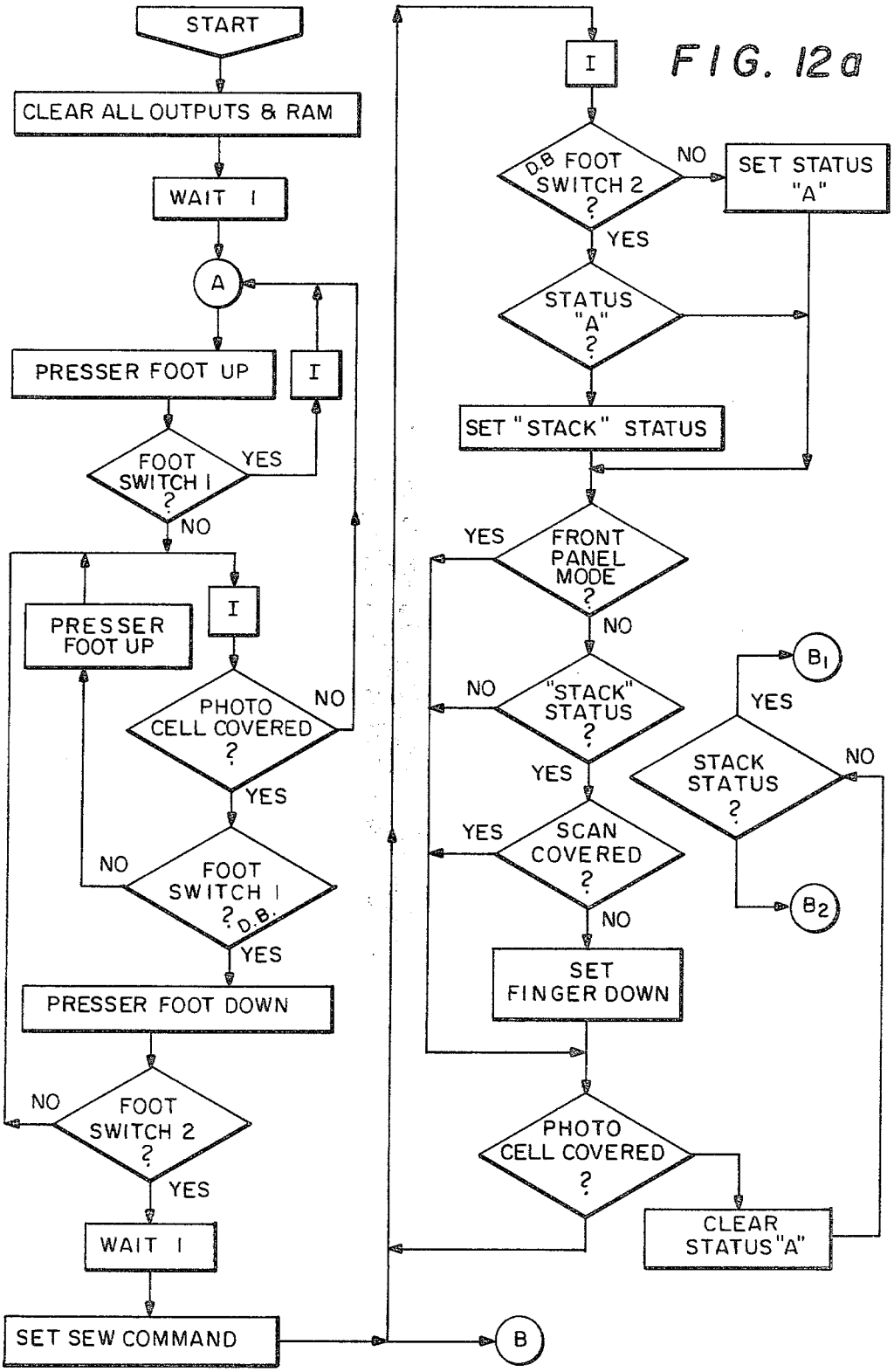
FIGS. 12*a*–12*d* are flowcharts representing the logic utilized in controlling the invention.
Figure 12B:
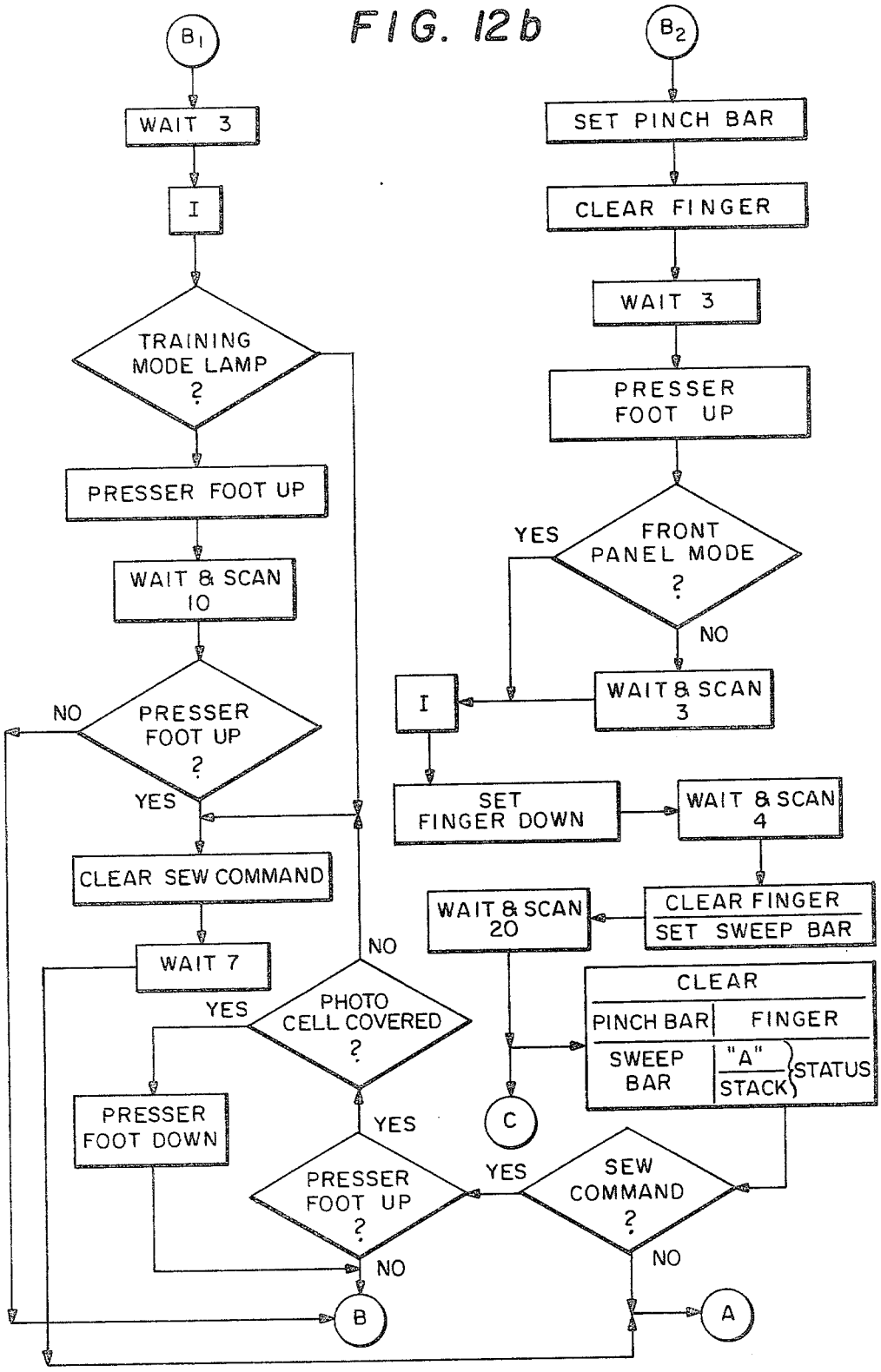
Figure 12C:
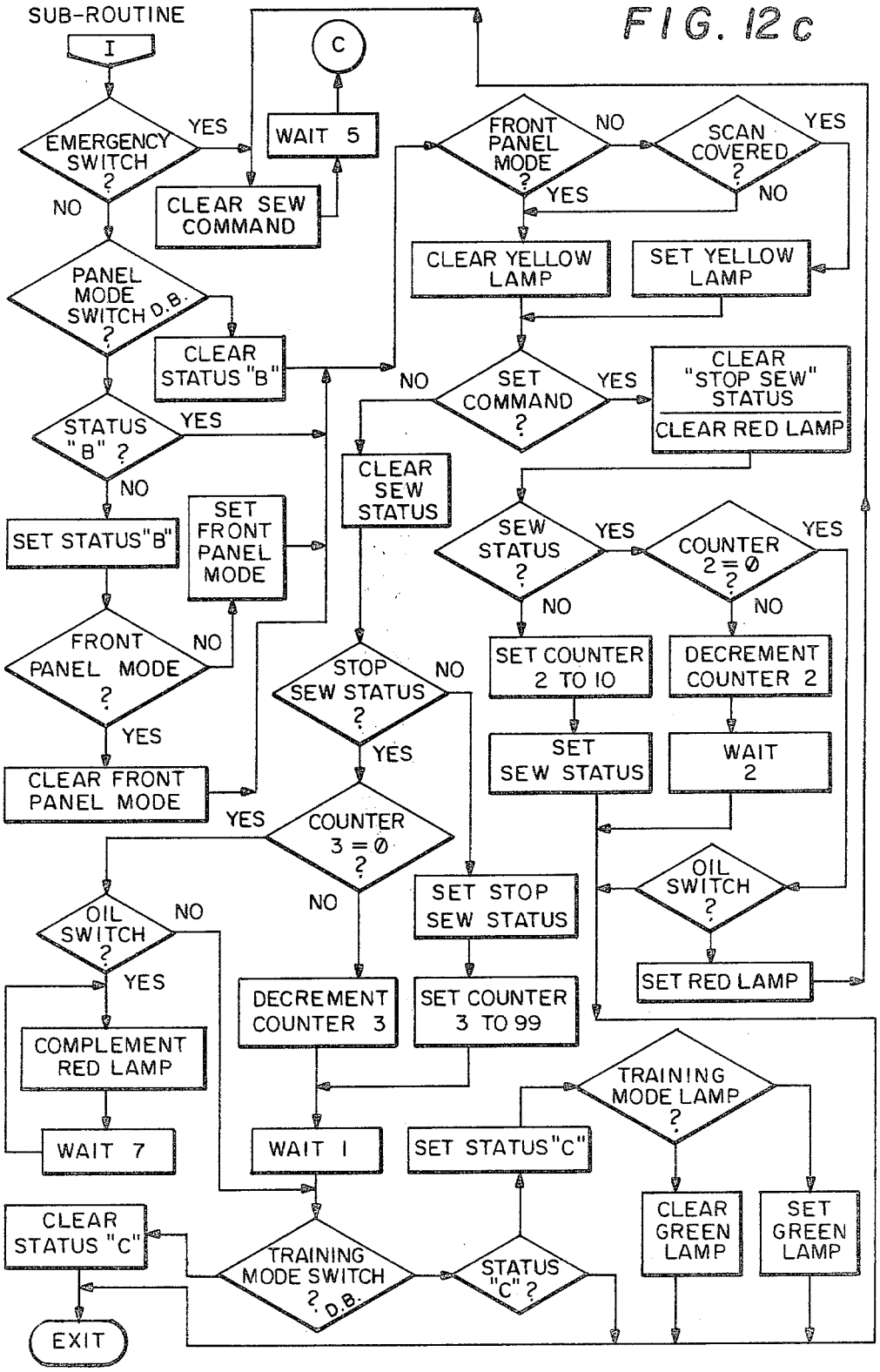
Figure 12D:
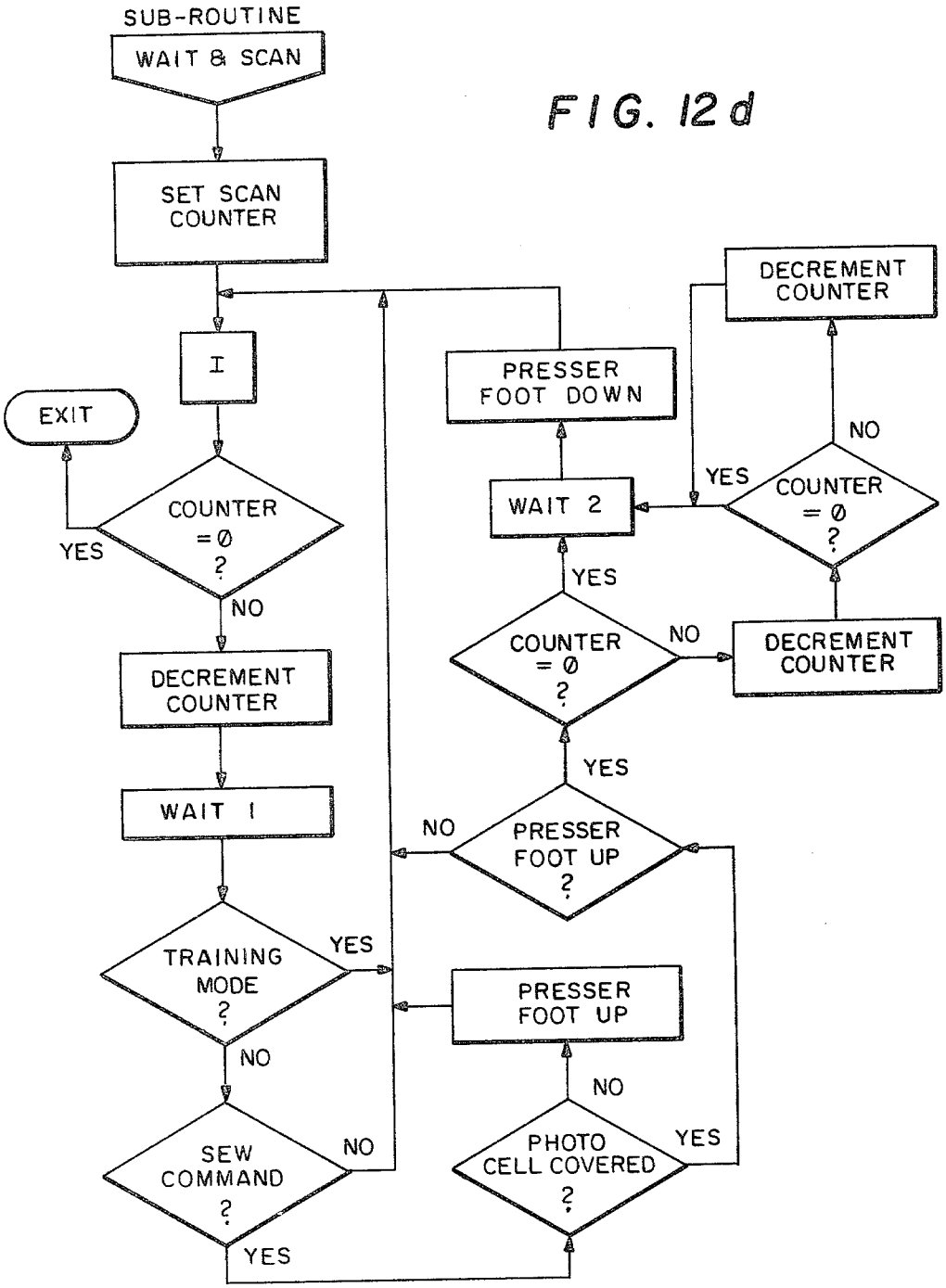
Figure 13:
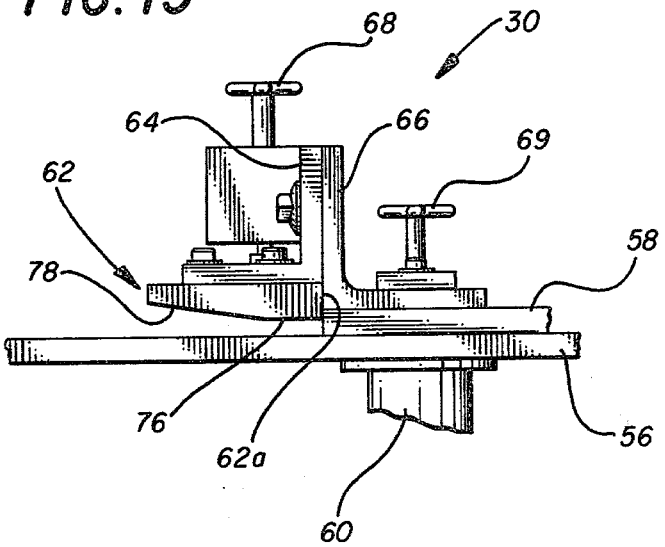
FIG. 13 is an end view of the material locator assembly taken along lines 13—13 of FIG. 4 in the direction of the arrows.

Referring to FIGS. 5–8, the configuration of guide member 62 comprises a significant part of the present invention. Guide member 62 is substantially straight in the forward and central portions. The rear end of guide member 62 is arcuate. The guide member 62 can be constructed of any suitable material, including plastic for example. The bottom of guide member 62 includes a substantially flat surface 76 extending along the inside edge 62*a* of the member. An inclined surface 78 extends along the outside edge of guide member 62 and intersects with surface 76. The rear end of guide member 62, which is closest to sewing machine 28, includes a notch 80 formed into surface 78. As is best shown in FIG. 8, the notch 80 is defined by a substantially flat roof surface and arcuate wall surfaces. The edges of a material panel received underneath the outside edge of guide member 62 are smoothed and aligned during feeding into the sewing machine 28. Surfaces 76, 78 and 80 together with plate 56 and the outside edge 58*a* of plate 58 thus define the material guide structure for apparatus 10.

The relationship between guide member 62 and sewing machine 28 is best illustrated in FIGS. 9 and 10. The sewing machine 28 includes the usual presser foot 82 and needle 84. The presser foot 82 comprises a substantially conventional presser foot with slight modifications to improve material feed. Preferably, the presser foot 82 is shortened at the forward end so that the rear end of guide member 62 can be positioned more closely to needle 84. In addition, the outside and trailing edges of presser foot 82 preferably curve upward as shown in FIG. 10.

Figure 15:
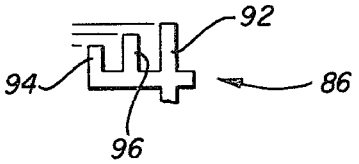
FIG. 15 is a partial end view of the sewing machine feed dog.

The sewing machine 28 also includes the usual feed dog 86 mounted for movement beneath presser foot 82 and needle 84. The feed dog 86 reciprocates within an opening in throat plate 88 in a counterclockwise direction when viewing FIG. 10 to feed material through the sewing machine 28 in the direction of arrow 90. The feed dog 86 is also substantially conventional in construction, except that the teeth thereon have been slightly modified. A conventional feed dog, such as that found on a Rimoldi Model 228 sewing machine, includes three rows 92, 94 and 96 of longitudinally extending teeth. According to the preferred construction of the invention, the points of the center row of teeth 96 on feed dog 86 are dulled, and the inside row of teeth 94 are ground down to a level approximately 0.002 inch below the center row. The outside row of teeth 92 on feed dog 86 positioned closest to the edge of a panel of material drawn through the sewing machine 28, is left intact. For clarity, the relationship between the teeth on feed dog 86 has been shown in FIG. 15 in exagerated form. With the teeth of feed dog 86 thus modified to achieve differential biting, a slight twisting force in the counterclockwise direction when viewing FIG. 9 is applied to a panel of material so that the edges thereof are maintained in positive engagement with guide member 62 during feeding through sewing machine 28. Feed dog 86 thus performs both feeding and steering functions.

Referring to FIG. 11, there is shown the stacker assembly 34 which can be employed with apparatus 10. Assembly 34 collects and stacks the sewn panels of material for subsequent assembly into garments. The stacker assembly 34 is attached to the rear panel 102 of table 16. Panel 102 extends between the rear legs of table 16 (not shown in FIG. 11) and can be used to support some of the electrical and pneumatic circuitry employed in apparatus 10. Stacker assembly 34 comprises side panels 104 and 106 extending outwardly from panel 102. A shelf 108 is positioned at the outer ends of panels 104 and 106. Strips of anti-slip material 110 are preferably placed along the edges of shelf 108. Bars 112 and 114 are connected to a pivot shaft 116 rotatably mounted between side panels 104 and 106. Outer sweep bar 112 is pivotally actuated by double acting cylinder 118. Inner pinch bar 114 is pivotally actuated by double acting cylinder 120.

The stacker assembly 34 operates in conjunction with the material clamp 122 shown in FIG. 3. Clamp 122 acts like a mechanical finger to selectively immobilize panels of material fed through apparatus 10. Clamp 122 is mounted at the end of a bracket 124 extending over plate 42. Clamp 122 comprises a double acting cylinder 126 actuating clamp pads 128.

After sewing the last edge of a panel of material, the panel is advanced over the forward edge of table 16. Stacker bars 112 and 114 are initially positioned so that the panel extends inside the bars. The panel is then stopped in proper position against table 16 by material clamp 122. Substantially simultaneously upon actuation of clamp 122, bar 114 is pivoted forward to pinch the panel against shelf 108. Upon release of clamp 122, bar 112 is pivoted forward to flip the material panel over shelf 108. Bars 112 and 114 are then returned to their initial positions near table 16 for receiving the next panel of material. If desired, a barrier, such as guard rail 130 shown in FIG. 1, can be provided around stacker assembly 34 for safety purposes.

Referring to FIGS. 12*a*–12*d*, there are shown the logic flowcharts representative of instructions and commands which can be programmed into the microprocessor enclosed in housing 32 of apparatus 10. The illustrative flowcharts in FIGS. 12*a*–12*d* are for an apparatus 10 set up to run trouser panels only. It will of course be understood that the structure disclosed herein can be used with any desired type of garment panel. Any suitable microprocessor of sufficient capacity can be utilized. In actual practice, a microprocessor manufactured by Intel Corporation of California, and packaged by Prolog Corporation has been found satisfactory. For example, the Prolog Model PLS-411 can be used. The abbreviation "S/R" means subroutine, and "I" means interrupt. Circles enclosing one or more letters represent corresponding entry or exit points in the control program. The rest of the instructions and decisions contained in the flowcharts are self-explanatory.

With continuing reference to the FIGURES, the operation of semi-automatic panel serger apparatus 10 is as follows. A precut garment panel, such as trousers panel 14 shown in FIG. 2, is placed on plate 42 by the operator. Photosensor 46 is thus covered. The first edge to be sewn is engaged beneath guide member 62 of material locator assembly 30, with the selected starting point on the edge being positioned beneath raised presser foot 82 and needle 84 of sewing machine 28. Photosensor 70 thus senses the positioning of a panel ready for sewing.

The operator can then actuate foot switch 38 to drop presser foot 82 of sewing machine 28 and begin the sewing operation. Guide member 62 smoothes and aligns the edge of the panel as it is drawn into sewing machine 28 by feed dog 86 and carried forward by the air flow from ports 50. No operator intervention is required until sewing machine 28 reaches a corner or sharp juncture in the periphery of the panel, whereupon the panel is manually turned to maintain engagement with material locator assembly 30. Upon reaching a corner, it will be appreciated that photosensor 70 becomes cleared, whereupon a timeout is initiated. Sewing machine 28 continues operating as long as photosensor 70 is either interrupted or cleared for less than a predetermined time. In the training mode, presser foot 82 and needle 84 raise and sewing machine 28 stops as each side is completed. In the semi-automatic mode, the sewing machine 28 stops only if photosensor 70 is cleared for too long. The desired serge, wraparound, or other edge stitch is thus quickly provided in this manner along each side of the panel.

At the start of the last side of the panel being stitched, the operator actuates switch 36 or 38 to initialize the stacker assembly 34. Clearance of photosensor 46 signals the end of a panel, while clearance of photosensor 70 indicates completion of a sewn panel. Clearance of photosensor 46 initiates a predetermined timeout, at the end of which material clamp 122 is actuated to prevent the sewn panel from slipping off table 16. In some panels, such as a back trousers panel, clamp 122 can be actuated before completion of the last side to interrupt panel feed just as the needle 84 approaches a curve in the periphery, which causes the panel to pivot enough to permit negotiation of the curve without help from the operator. Otherwise, clamp 122 is actuated after the panel is through sewing machine 28, which continues sewing an interlaced thread drawn down and severed by a cutter included in the machine.

As material clamp 122 is finally released, outer arm 122 of stacker assembly 34 is pivotally actuated to flip the sewn panel over shelf 108. Arm 114 is preferably actuated first to pinch the panel against the edge of shelf 108. No further manual intervention is thus required after an operator signals that the last side of the panel is being sewn. It will thus be appreciated that the operator can reach for another panel and position it for sewing directly behind the previous panel without interruption of sewing machine 28.

From the foregoing, it will be understood that the present invention comprises a semi-automatic panel serger apparatus having numerous advantages over the prior art. One significant advantage involves the fact that no active mechanical devices are employed in guiding panels into the sewing machine. Simplified construction enhances reliability and reduces both maintenance and expense. Use of the present invention reduces the skill and training necessary for an operator to become proficient. Material panels serged with the invention are flatter, less drawn and less puckered than hand-serged panels. Other advantages will suggest themselves to those skilled in the art.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and/or elements without departing from the spirit and scope of the invention.

We claim:

1. In combination with a sewing machine of the type having stitching means and means for feeding material supported by a working surface with a guide edge thereon along a material feed path past the stitching means, the improvement which comprises:

a guide member supported over the working surface and adjacent the guide edge along the feed path in front of the sewing machine for engaging and guiding the edge of the material into the sewing machine;

said guide member having an underside with inside and outside edges;

the underside of said guide member having a guide surface including an arcuate notch of substantially constant height located in one end of the outside edge, an inwardly declined surface located in the other end of the outside edge, and a substantially flat surface located along the inside edge.

2. The improvement of claim 1, further including:

said working surface having a plurality of ports positioned adjacent to the sewing machine; and means for discharging air through the ports to urge the material along the feed path.

3. The improvement of claim 1, further including:

means for adjustably supporting said guide member in selective spaced relationship over the working surface.

4. The improvement of claim 1, further including:

means mounted in the working surface for sensing material located in predetermined proximity with the sewing machine;

means mounted in the guide member for sensing material in engagement therewith;

means responsive to at least one of said sensing means for selectively immobilizing the material against the working surface; and means located along the feed path behind the sewing machine and adjacent to the working surface for receiving and stacking the material after sewing.

5. A guide member for use with a sewing machine, comprising:

a rigid body having an arcuate portion at one end and a substantially straight portion at the opposite end;

said body including an underside defining a guide surface with a substantially flat surface extending along one edge of the underside and a receiving surface extending along the other edge of the underside;

said receiving surface being defined by an arcuate notch formed in the arcuate portion and an outwardly inclined surface formed in the straight portion.

6. Apparatus for providing a stitch along the edges of a material panel, comprising:

a sewing machine having a movable material feed dog and reciprocable needle;

structure defining a support surface surrounding at least a portion of the sewing machine;

an edge member secured to said support surface in front of said sewing machine;

a guide member located in spaced relationship over said support surface adjacent to said edge member for engaging and guiding edges of the material panel into the sewing machine;

said guide member including an underside with inner and outer edges;

the underside of said guide member including a guide surface defined by an arcuate notch of substantially constant height located in the outer edge of the proximal underside, a substantially straight outwardly inclined surface located in the outer edge of the distal underside, and a substantially flat surface extending along the inner edge; and means for sensing a material panel located in predetermined positions on said support surface relative to said sewing machine.

7. The apparatus of claim 6, further including:

said support surface having a plurality of ports positioned adjacent to the sewing machine; and means for discharging air through the ports to reduce friction between each material panel and the support surface.

8. The apparatus according to claim 7, wherein at least some of the ports are angled in a predetermined direction so that the material panels are also urged forward.

9. The apparatus of claim 6, further including:

means for adjustably supporting said guide member in selective spaced relationship above the support surface.

10. The apparatus of claim 6, wherein the sewing machine feed dog includes at least two longitudinal rows of teeth, at least one of said rows being of relatively reduced height to achieve differential bite so that a moment is generated maintaining each material panel in positive engagement with the guide member.

11. The apparatus of claim 6, further including:

means responsive to said sensing means for selectively immobilizing each material panel against the support surface; and means responsive to said sensing means and located behind the sewing machine and adjacent to the support surface for receiving and stacking the material panels after sewing.

12. The apparatus according to claim 11, wherein the receiving and stacking means comprises:

a stationery shelf located in spaced relationship with the support surface;

an outer arm mounted for pivotal movement between a position over the shelf and a position underneath the edge of the support surface;

an inner arm mounted for pivotal movement between a position against the shelf and a position underneath the edge of the support surface; and means for selectively actuating the inner and outer arms to flip onto the shelf a material panel extending over the support surface.

13. Apparatus for sewing the edges of material panels, comprising:

a sewing machine including a movable material feed dog for advancing material along a feed path past a reciprocable needle;

structure defining a support surface surrounding at least a portion of the sewing machine;

an edge member secured to the support surface along the feed path in front of said sewing machine;

a guide member positioned over the support surface adjacent to said edge member for engaging and guiding the edges of each material panel into the sewing machine;

said guide member including an underside with inner and outer edges defined by an arcuate notch located along the outer edge in the proximal underside thereof, and a substantially straight inwardly declined surface located along the outer edge in the terminal underside thereof;

means mounted in the support surface for sensing a material panel located in predetermined proximity ahead of said sewing machine;

means mounted in said guide member for sensing a material panel in edgewise engagement therewith;

means responsive to at least one of said sensing means for selectively immobilizing each material panel; and means located behind said sewing machine and responsive to at least one of said sensing means for selectively receiving and stacking each material panel after sewing.

14. The apparatus of claim 13, further including:

means for adjustably supporting said guide member in selective spaced relationship above the support surface.

15. The apparatus of claim 13, wherein the sewing machine feed dog includes at least two longitudinal rows of teeth, at least one of said rows being of relatively reduced height to achieve differential bite so that a moment is generated maintaining positive engagement between each material panel and the guide member.

16. The apparatus of claim 13, wherein the receiving and stacking means comprises:

a stationery shelf located in spaced relationship with the support surface;

an outer arm mounted for pivotal movement between a position over the shelf and a position underneath the support surface;

an inner arm mounted for pivotal movement between a position against the shelf and a position underneath the support surface; and means for selectively actuating the inner and outer arms to flip onto the shelf a material panel extending over the support surface.

17. The apparatus of claim 13, further including:

said support surface having a plurality of ports positioned adjacent to the sewing machine; and means for discharging air through the ports to reduce friction between each material panel and the support surface.

* * * * *